US010710387B2

(12) United States Patent
Hirose

(10) Patent No.: US 10,710,387 B2
(45) Date of Patent: Jul. 14, 2020

(54) PRINTER INCLUDING A CONTAINER FOR A ROLL BODY IN WHICH A BELT-SHAPED PRINT MEDIUM IS WOUND

(71) Applicant: SATO HOLDINGS KABUSHIKI KAISHA, Tokyo (JP)

(72) Inventor: Kenji Hirose, Saitama (JP)

(73) Assignee: SATO HOLDINGS KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/511,916

(22) PCT Filed: Dec. 24, 2015

(86) PCT No.: PCT/JP2015/085937
§ 371 (c)(1),
(2) Date: Mar. 16, 2017

(87) PCT Pub. No.: WO2016/104562
PCT Pub. Date: Jun. 30, 2016

(65) Prior Publication Data

US 2017/0291438 A1 Oct. 12, 2017

(30) Foreign Application Priority Data

Dec. 25, 2014 (JP) ..... 2014-262370

(51) Int. Cl.
*B41J 29/02* (2006.01)
*B41J 3/36* (2006.01)
(Continued)

(52) U.S. Cl.
CPC ..... *B41J 29/02* (2013.01); *B41J 3/36* (2013.01); *B41J 3/4075* (2013.01); *B41J 15/04* (2013.01);
(Continued)

(58) Field of Classification Search
None
See application file for complete search history.

(56) References Cited

U.S. PATENT DOCUMENTS 5,657,066 A 8/1997 Adams et al.
6,364,550 B1 * 4/2002 Petteruti ..... B41J 3/36 400/103
(Continued)

FOREIGN PATENT DOCUMENTS

EP 1 798 052 A1 6/2007
EP 1 900 539 A2 3/2008
(Continued)

OTHER PUBLICATIONS

Extended European Search Report, dated Jun. 19, 2018, 9 pages.
Japanese Office Action and English translation, dated Nov. 27, 2018, 9 pages.

*Primary Examiner* — Jill E Culler
(74) *Attorney, Agent, or Firm* — Foley & Lardner LLP

(57) ABSTRACT

An embodiment of a printer according to the present invention includes: a container configured to contain a roll body into which a belt-shaped print medium is wound; a frame including a first opening, the frame arranged to be a portion of the container; and a body case provided outside the frame and arranged to be a portion of a bottom surface of the container, the body case including a first protrusion part protruding toward the first opening.

30 Claims, 11 Drawing Sheets

(51) Int. Cl.

| | |
|---|---|
| ***B41J 15/04*** | (2006.01) |
| ***B41J 29/00*** | (2006.01) |
| ***B41J 3/407*** | (2006.01) |
| ***B41J 29/13*** | (2006.01) |
| ***B65C 9/18*** | (2006.01) |
| *B41J 11/00* | (2006.01) |

(52) U.S. Cl.

CPC ..... *B41J 15/048* (2013.01); *B41J 29/00* (2013.01); *B41J 29/023* (2013.01); *B41J 29/13* (2013.01); *B65C 9/18* (2013.01); *B41J 11/0045* (2013.01); *B41J 15/042* (2013.01); *B41J 15/046* (2013.01)

(56) References Cited

U.S. PATENT DOCUMENTS

| | | | | |
|---|---|---|---|---|
| 6,414,704 | B1 * | 7/2002 | Yamashita | B41J 29/02 347/222 |
| 7,287,850 | B2 * | 10/2007 | Matsui | B41J 3/36 347/108 |
| 7,825,944 | B2 | 11/2010 | Kaiya | |
| 7,909,522 | B2 * | 3/2011 | Heaton | B41J 3/36 242/578 |
| 8,616,699 | B2 * | 12/2013 | Mistyurik | B41J 3/4075 347/109 |
| 9,073,370 | B1 * | 7/2015 | Takabatake | B41J 11/70 |
| 2007/0139505 | A1 | 6/2007 | Kaiya | |
| 2008/0066636 | A1 | 3/2008 | Shimizu | |
| 2011/0026999 | A1 | 2/2011 | Kohira | |
| 2013/0050385 | A1 | 2/2013 | Tanaka et al. | |

FOREIGN PATENT DOCUMENTS

| | | | |
|---|---|---|---|
| JP | 61-021743 | U1 | 2/1986 |
| JP | 07-097114 | A | 4/1995 |
| JP | 10-501750 | A | 2/1998 |
| JP | 2000-289272 | A | 10/2000 |
| JP | 2001-253604 | A | 9/2001 |
| JP | 2005-88350 | A | 4/2005 |
| JP | 2007-160771 | A | 6/2007 |
| JP | 2012-206278 | A | 10/2012 |
| JP | 2013-49174 | A | 3/2013 |

* cited by examiner

Enlarged part E

PRINTER INCLUDING A CONTAINER FOR A ROLL BODY IN WHICH A BELT-SHAPED PRINT MEDIUM IS WOUND

TECHNICAL FIELD

The present invention relates to a printer including a container configured to contain a roll body into which a belt-shaped print medium is wound.

BACKGROUND ART

It is conventionally known a mobile printer including a container configured to contain a paper roll for example as a roll body into which a belt-shaped print medium is wound (see Japanese laid-open patent publication JP 2012-206278, for example). The printer described in the Japanese laid-open patent publication JP 2012-206278 is provided with a paper roll holder covered by a cover frame that is openable and closable at a rear side of the substantially box-shaped inside of a body frame. That is, it is described that the paper roll holder and the body frame are formed with a double-layered structure.

SUMMARY OF THE INVENTION

Problems to be Solved by the Invention

Rigidity of the printer housing of the conventional mobile printer of a double-layered structure as described in the patent literature 1 is higher than that of a single-layer structure. However, applying a double-layered structure may cause the printer to be heavier, and mobility, which is required for a mobile printer, may be therefore compromised.

In view of the aspect as described above, the present invention aims to provide a printer including a printer housing having high rigidity and light weight.

Means for Solving the Problems

An embodiment of the present invention is a printer including: a container configured to contain a roll body into which a belt-shaped print medium is wound; a frame including a first opening, the frame arranged to be a portion of the container; and a body case provided outside the frame and arranged to be a portion of a bottom surface of the container, the body case including a first protrusion part protruding toward the first opening.

In the printer described above, a circumferential edge of the first opening may be formed at a portion of the bottom surface of the container.

In the printer described above, a top surface of the first protrusion part may be formed to be a concave curve that conforms to the shape of the bottom surface of the container, the concave curve being formed to conform to the shape of the outer circumferential surface of the roll body.

In the printer described above, the first protrusion part may engage with the circumferential edge of the first opening.

In the printer described above, the first protrusion part may include a plurality of ribs.

In the printer described above, the frame may include a battery container configured to contain a battery for supplying electric energy to the printer, the battery container including a second opening at a bottom surface thereof, and the body case includes a second protrusion part protruding from the second opening, the second protrusion part for placing the battery thereon.

In the printer described above, the second protrusion part may extend in a longitudinal direction of the battery container, the body case may include a third protrusion part extending in parallel with the second protrusion part, and the frame may include a plate-shaped part fitting a gap between the second protrusion part and the third protrusion part.

Effect of the Invention

The printer described above allows a printer housing to have high rigidity and light weight.

DETAILED DESCRIPTION OF THE INVENTION (1) Whole Structure of a Printer

A whole structure of a mobile printer, as an embodiment of the present invention, will be described with reference to FIGS. 1 to 4.

Figure 1:
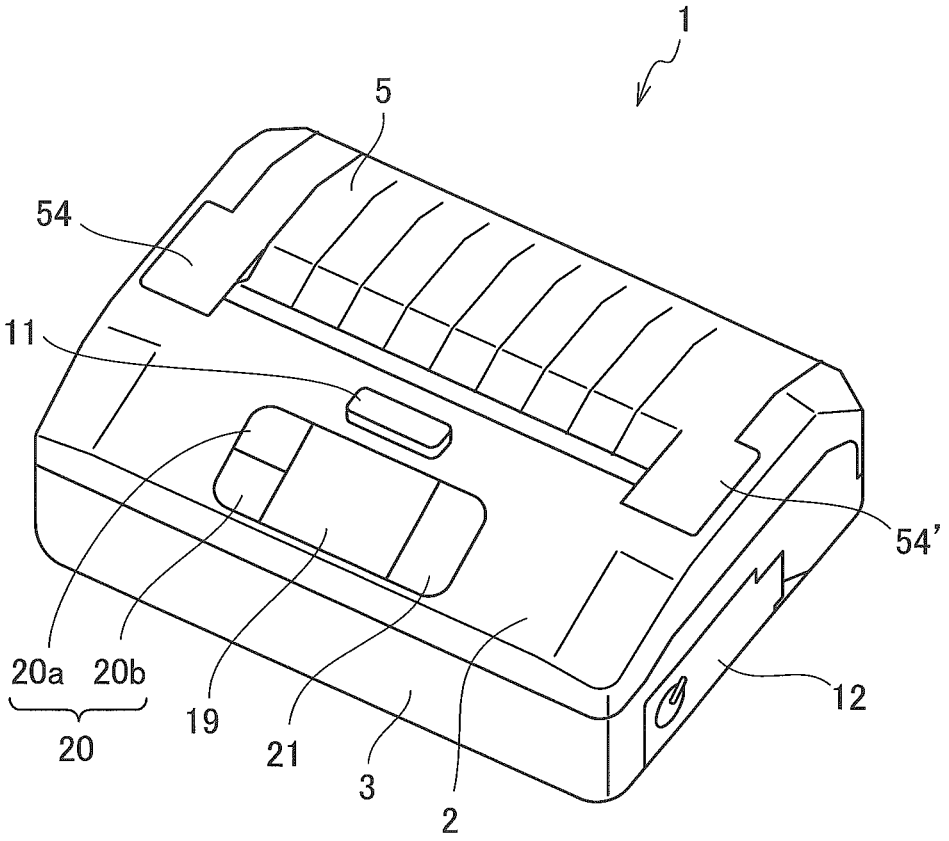
FIG. 1 is a perspective view of a printer according to an embodiment.
Figure 2:
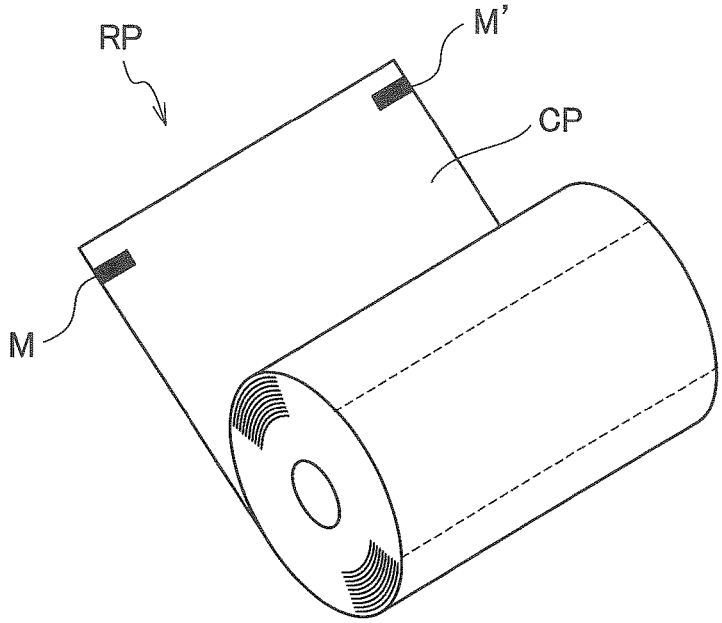
FIG. 2 is a perspective view of the printer according to the embodiment when an opening and closing cover is open.
Figure 2:
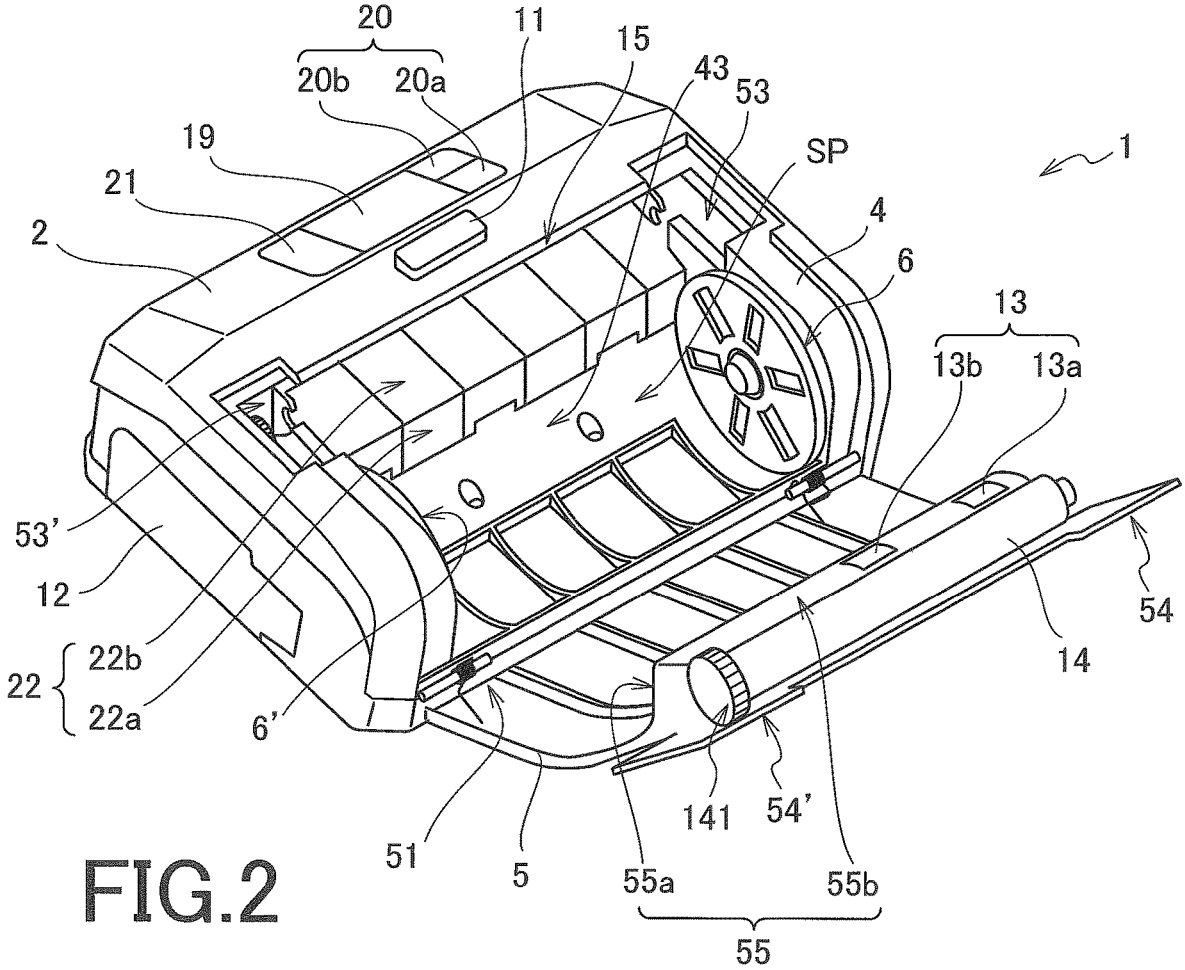
Figure 3:
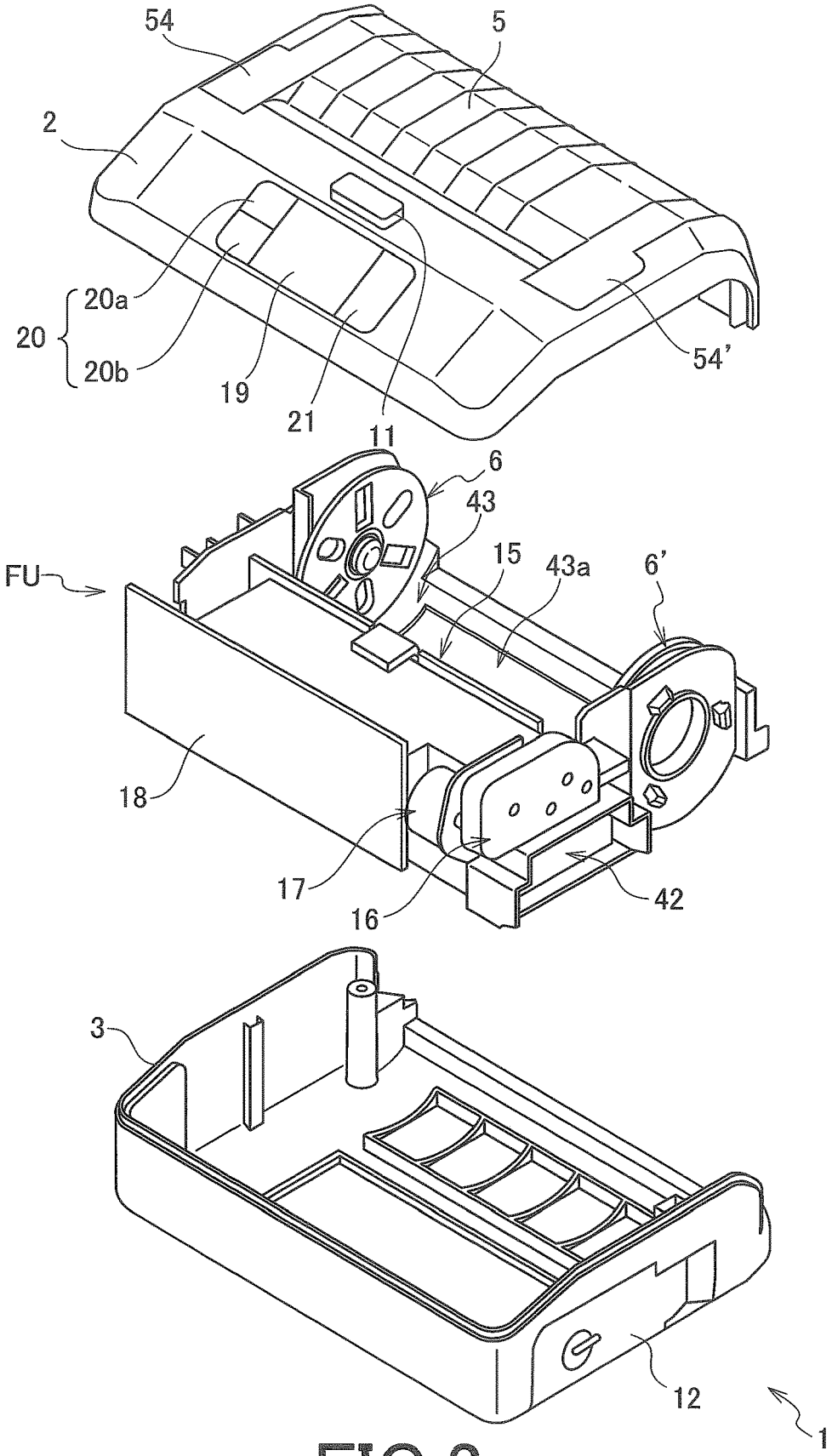
FIG. 3 is an exploded perspective view of a rough structure of a housing of the printer according to the embodiment.
Figure 4:
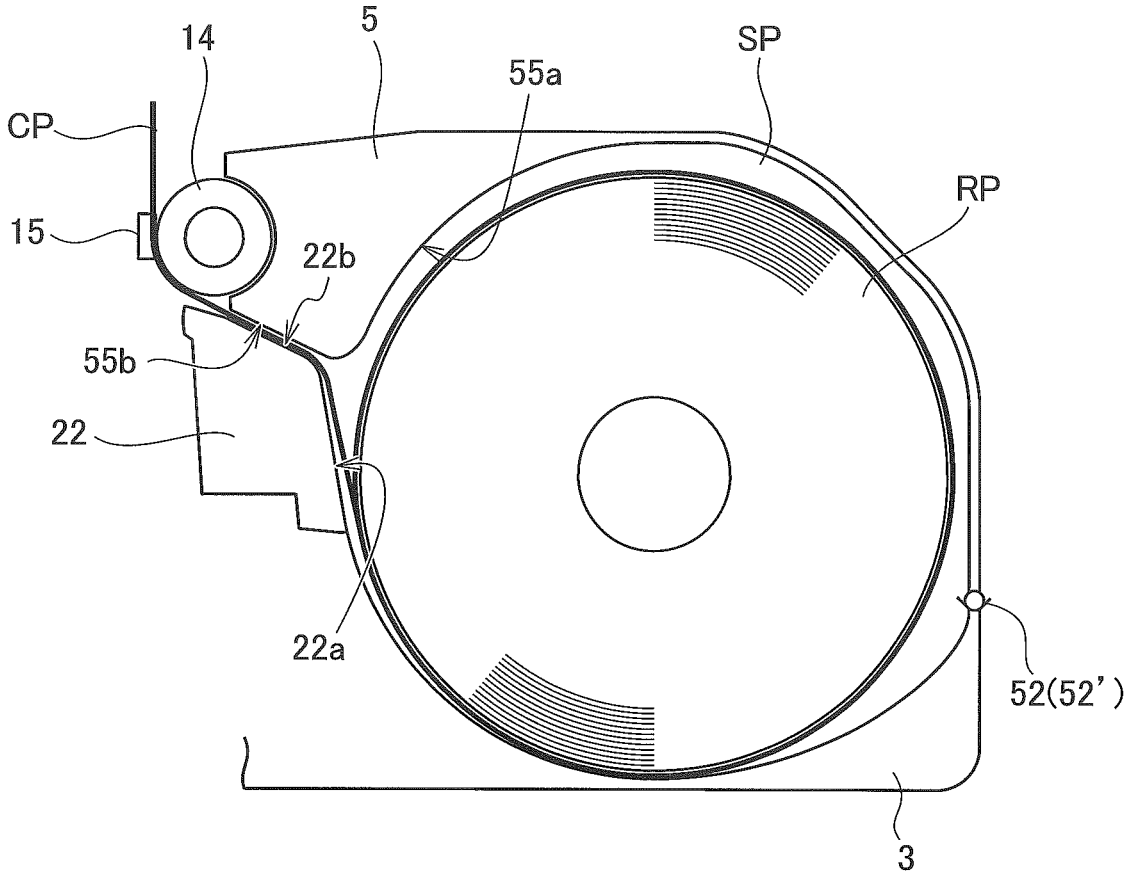
FIG. 4 shows a paper path in the printer according to the embodiment.

FIG. 1 is a perspective view of a printer 1 according to the present embodiment. FIG. 2 is a perspective view of the printer 1 according to the embodiment when an opening and closing cover 5 is open, together with a paper roll RP as an example of a roll body. FIG. 3 is an exploded perspective view of a rough structure of a housing of the printer 1 according to the embodiment. FIG. 4 shows a paper path in the printer 1 according to the embodiment.

The printer 1 is a mobile printer containing a paper roll (an example of a roll body) into which a belt-shaped continuous paper (an example of print medium) is wound. The printer 1 prints on a print face of the continuous paper. As illustrated in FIG. 1, the printer 1 has wholly a cuboid shape.

As illustrated in FIG. 3, a front cover 2 and a body case 3 are coupled each other with a screw (not illustrated) in the printer 1. A frame 4, in which a function unit FU is mounted, is sandwiched between the front cover 2 and the body case 3, and thus the function unit FU is protected. The frame 4 is fixed to the body case 3 with a screw (not illustrated).

As illustrated in FIGS. 1 to 3, the front cover 2 includes: a push-to-open button 11; a display part 19; operation buttons 20 including an operation button 20*a* and an operation button 20*b*; and a power switch 21. An opening and closing cover 5 is attached to the front cover 2. The opening and closing cover 5 opens or closes a container SP that contains a paper roll RP, which will be described later.

The push-to-open button 11 is a button for opening the opening and closing cover 5. The display part 19 is a screen that displays an operation command, a message or the like, and includes a liquid crystal display (LCD) for example. Each of the operation button 20*a* and the operation button 20*b* is a button for an operator to instruct an action of the printer 1. The power switch 21 is a button for turning on or off a power supply of the printer 1.

As illustrated in FIGS. 1 and 3, the body case 3 is coupled to the front cover 2 so as to face the opening and closing cover 5. The body case 3 and the front cover 2 form a printer housing. As illustrated in FIG. 3, the frame 4, in which a function unit FU is mounted, is fixed to the body case 3 with a screw (not illustrated). As illustrated in FIGS. 1 to 3, a battery cover 12 is openably and closably attached to the body case 3. The battery cover 12 is an opening and closing cover of a battery container 42 (see FIG. 3) of the frame 4 that contains a battery (not illustrated) as a power supply.

As illustrated in FIG. 2, the paper roll RP used in the printer 1 is a roll body into which a belt-shaped continuous paper CP is wound. The printer 1 employs a drop-in type loading system with which the paper roll RP is contained (loaded) into the container SP when the opening and closing cover 5 is open. With the drop-in type loading system, the paper roll RP can be easily loaded downward with respect to a guide axis that is defined by a pair of paper roll guides 6, 6'. The pair of paper roll guides 6, 6' is provided in the container SP.

In an example of the present embodiment, the paper roll RP is not equipped with a core, and is produced by winding the belt-shaped continuous paper CP so as to have a cylindrical hollow part with a predetermined radius.

The continuous paper CP includes meter reading forms with predetermined intervals in a longitudinal direction. Adjoining meter reading forms in the continuous paper CP are sectioned by a line of perforation. Though not illustrated, each meter reading form includes print regions corresponding to three or four sub-forms. Adjoining print regions are sectioned by a line of perforation. Formed in the longitudinal direction on a back face, which is the other side of a print face of the continuous paper CP, are a pair of location detection marks M, M' indicating: a print reference location of each meter reading form (that is, a print reference location of the first sub-form), and a print reference location of each print region of the second sub-form and thereafter. Each of the pair of location detection marks M, M' is rectangular and printed in black on the back face of the continuous paper CP. In each meter reading form, the location detection marks indicating each print region of the second sub-form and thereafter, may be different from those indicating the print reference location of the first sub-form.

A thermosensitive color developing layer is formed on the print face of the continuous paper CP. When the temperature reaches a predetermined range, the thermosensitive color developing layer develops a specific color.

As illustrated in FIGS. 2 and 3, the frame 4 is arranged to be a portion of the container SP of the paper roll RP. Attached to the frame 4 is the pair of paper roll guides 6, 6' that supports the sides (that is, both sides in a width direction) of the paper roll RP from both sides in the container SP. The pair of paper roll guides 6, 6' guides the both sides of the paper roll RP while the paper roll RP rotates.

As illustrated in FIG. 3, the function unit FU includes: a thermal head 15, gears 16, a stepping motor 17, and a circuit board 18. The thermal head 15 is provided so as to face the platen roller 14 when the opening and closing cover 5 is closed. The thermal head 15 includes heater elements that generate heat for printing to be given to the thermosensitive color developing layer of the print face of the continuous paper CP, which is fed by the platen roller 14. Mounted on the circuit board 18 are: a controller for controlling print action(s), and an electrical circuit that drives the stepping motor 17 for feeding the continuous paper CP and drives the heater elements of the thermal head 15.

The opening and closing cover 5 opens or closes the container SP. The opening and closing cover 5 is axially supported by an opening and closing shaft 51 via a hinge or the like. The opening and closing cover 5 is biased to open by a pair of torsion springs 52, 52' (see FIG. 4) that are disposed along the opening and closing shaft 51.

As illustrated in FIG. 2, the opening and closing cover 5 is provided with the platen roller 14 along an axis parallel with the opening and closing shaft 51, in a vicinity of the end opposite to the opening and closing shaft 51. The platen roller 14 is feeding means for feeding the continuous paper CP extracted from the paper roll RP.

A pair of side strips 54, 54' is formed on the both side of the opening and closing cover 5. When the opening and closing cover 5 is closed, a pair of coupling space 53, 53' (see FIG. 2) is closed by the pair of side strips 54, 54'. The pair of coupling space 53, 53' is space where a platen roller gear 141 of the platen roller 14 engages with the gears 16 (see FIG. 3). When the platen roller gear 141 engages with the gears 16, the platen roller 14 is operable, thereby allowing the print face of the continuous paper CP to be printed.

As illustrated in FIGS. 2 and 4, sensors 13 including a sensor 13*a* and a sensor 13*b* are disposed on a surface of the opening and closing cover 5 facing the paper path when the opening and closing cover 5 is closed.

The sensor 13*a* detects the print reference location of each meter reading form (that is, one of the pair of location detection marks M, M' of the continuous paper CP). The sensor 13*a* is a reflective type optical sensor. The reflective type optical sensor includes a light emitter and a light receiver (not illustrated). The light emitter emits light toward the back face of the print face of the continuous paper CP. The light receiver receives light reflected from the back face of the print face (namely, reflected light). The light receiver performs photoelectric conversion with respect to the reflected light in accordance with light intensity thereof, and outputs electric signals to the controller (not illustrated) in the circuit board 18. The light intensity corresponds to amount of received light of the reflected light per unit time. A level of the reflected light from the black location detection mark (which is an equivalent of a signal level output to the controller) is different from that from a part of the back face other than the location detection mark (a white surface, for example). Thereby, the controller can judge whether or not the location detection mark exists.

The sensor 13*b* is used, not for the paper roll RP illustrated in FIG. 2, but for a paper roll made by winding a belt-shaped liner to which a plurality of aligned labels adheres. The sensor 13*b* identifies an adhesion starting position of each label. For example, the sensor 13*b* detects whether or not a label exists (that is, a position where a label adheres to the liner, or a position where a label does not adhere to the liner). The position where a label does not adhere to the liner is any position between adjoining labels. The sensor 13*b* is a thru-beam type optical sensor. The thru-beam type optical sensor includes a light emitter and a light receiver (not illustrated) respectively provided on a label adhesive face side and the back side thereof. The light emitter emits light from the back side of the label adhesive face side toward the liner. The light receiver receives, among the emitted light, light component that transmits through the liner alone, or light component that transmits through both the liner and the label (namely, transmitted light). The light receiver performs photoelectric conversion with respect to the transmitted light in accordance with light intensity thereof, and outputs electric signals to the controller in the circuit board 18. A level of the transmitted light at a part of the liner where a label adheres (which is an equivalent of a signal level output to the controller) is different from that at a part of the liner where a label does not adhere. Thereby, the controller can identify the adhesion starting position of each label.

The controller in the circuit board 18 controls print timing based on a signal level output from the reflective type optical sensor or the thru-beam type optical sensor. As illustrated in FIG. 2, an inner face 55 of the opening and closing cover 5 includes a curve surface 55*a* and a guide surface 55*b* along the shaft of the platen roller 14. The sensors 13*a*, 13*b* described above are attached to the guide surface 55*b* of the inner face 55. A feed guide 22 is fixed to the frame 4. The feed guide 22 includes a wall surface 22*a* and a guide surface 22*b*.

FIG. 4 is a schematic sectional side view of a part of the printer 1 when the paper roll RP is contained and the opening and closing cover 5 is closed. In FIG. 4, the paper path is indicated in a bold line in a case in which the paper roll RP, into which the continuous paper CP is wound in a counter-clockwise direction from a side view of the printer 1, is inserted into the container SP of the printer 1.

As illustrated in FIG. 4, when the opening and closing cover 5 is closed, the curve surface 55*a* of the opening and closing cover 5 and the wall surface 22*a* of the feed guide 22 form a portion of an inner wall of the container SP. The guide surface 55*b* of the opening and closing cover 5 and the guide surface 22*b* of the feed guide 22 are located so as to face with a slight gap. This gap corresponds to the paper path of the continuous paper CP, which is extracted from the paper roll RP, directing from the container SP to the platen roller 14. In the gap corresponding to the paper path, the sensors 13*a*, 13*b* are provided on the guide surface 55*b* of the opening and closing cover 5. The sensors 13*a*, 13*b* detect one of the pair of location detection marks M, M' when the continuous paper CP advances through the gap.

As illustrated in FIG. 4, in a case in which the paper roll RP, into which the continuous paper CP is wound in a counter-clockwise direction from a side view of the printer 1, is inserted into the container SP of the printer 1, a tip of the continuous paper CP extracted from the paper roll RP advances toward the platen roller 14, along the wall surface 22*a* of the feed guide 22 and the gap between the guide surface 22*b* and the guide surface 55*b*. The guide surface 22*b* and the guide surface 55*b* are angled, with respect to the wall surface 22*a*, in an opposite direction to the winding direction of the paper roll RP. Thus, curl of the continuous paper CP wound in a counter-clockwise direction is reduced during a period of time in which the continuous paper CP advances toward the platen roller 14.

In the printer 1 of the present embodiment, the continuous paper CP extracted from the paper roll RP is fed to the platen roller 14 through the paper path shown in FIG. 4, and printing is performed to each meter reading form while the continuous paper CP is pinched between the platen roller 14 and the thermal head 15. Timing for printing to each meter reading is determined based on one of the pair of location detection marks M, M' detected by the sensor 13*a* for example.

(2) Structure of the Frame 4

As illustrated in FIGS. 1 and 3, the body case 3 and the opening and closing cover 5 form the printer housing of the printer 1 of the present embodiment. The frame 4 is disposed between the front cover 2 and the body case 3. That is, the frame 4 is disposed inside the printer housing.

The structure of the frame 4 will be described below with reference to FIGS. 2, 3, 5, and 6.

Figure 5:
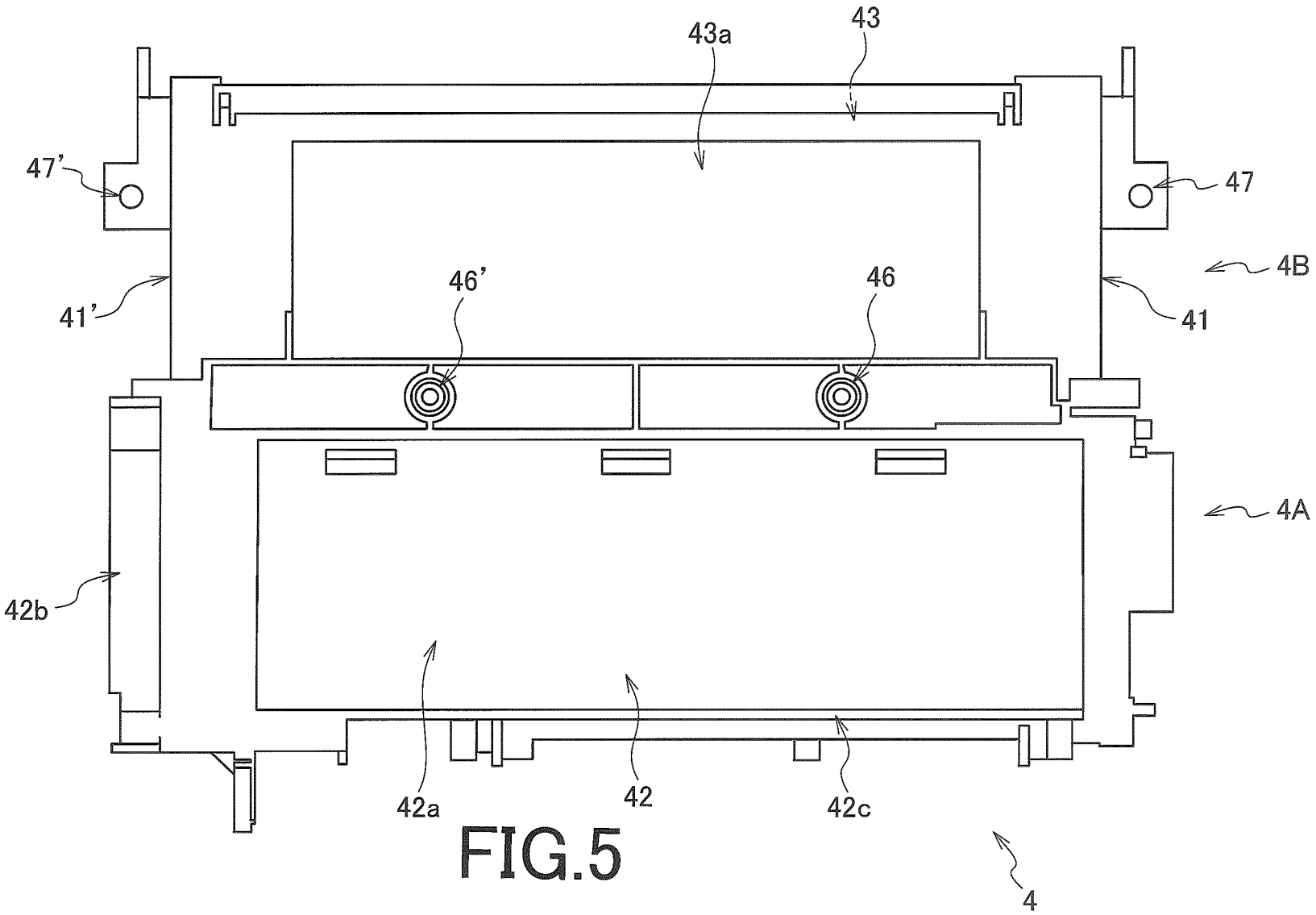
FIG. 5 is a bottom view of a frame of the printer according to the embodiment.
Figure 6:
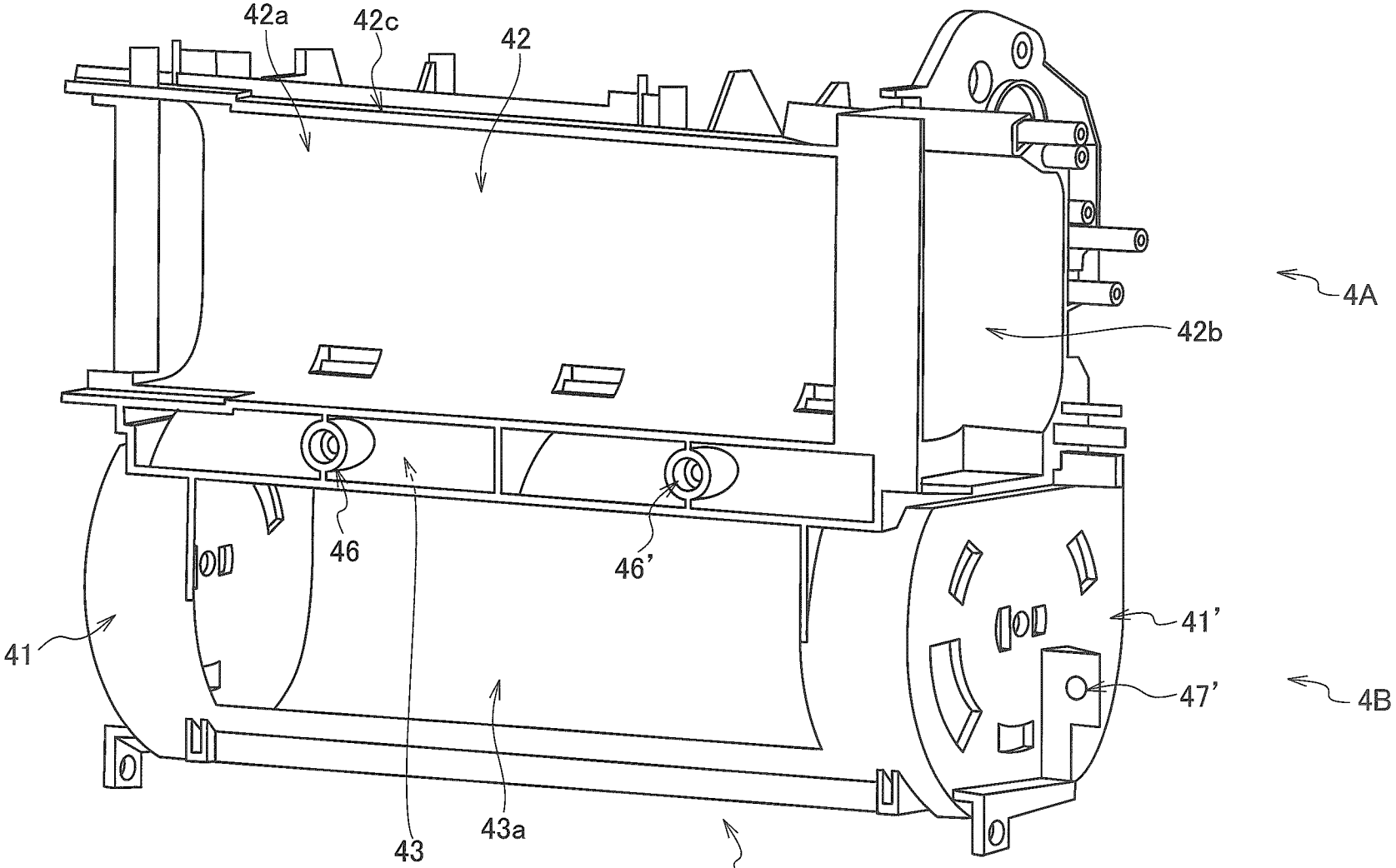
FIG. 6 is a perspective view of the frame of the printer according to the embodiment as seen from a bottom surface side.

FIG. 5 is a bottom view of the frame 4 of the printer 1 according to the embodiment. FIG. 6 is a perspective view of the frame 4 of the printer 1 according to the embodiment as seen from a bottom surface side.

As illustrated in FIGS. 5 and 6, the frame 4 includes: a front part 4A that forms the battery container 42 and mounts the function unit FU thereon, and a rear part 4B that forms the container SP. In the following description, with reference to FIG. 2, a side of the printer 1 on which the display part 19 and the power switch 21 are disposed, will be referred to as a front side of the printer 1, while a side of the printer 1 on which the container SP is disposed will be referred to as a rear side of the printer 1.

As illustrated in FIG. 6, a rectangular opening 42*a* is formed at the bottom of the battery container 42 provided in the front part 4A of the frame 4. A battery inlet 42*b* for inserting a battery therefrom is located at the lateral part of the battery container 42 (at the side of the printer 1 on which the battery cover 12 is attached). As illustrated in FIGS. 5 and 6, a plate-like portion 42*c* is formed to define the periphery of the battery container 42 on the front side of the battery container 42. The plate-like portion 42*c* is linear from a plan view.

As illustrated in FIGS. 3 and 6, an attachment part is provided for attaching the function unit FU including the gears 16, the stepping motor 17, and the circuit board 18, etc. in the front part 4A of the frame 4.

As illustrated in FIGS. 2 and 6, a bottom surface 43 of the container SP is formed in the rear part 4B of the frame 4. The bottom surface 43 of the container SP is opposed to the opening and closing cover 5 when the opening and closing cover 5 is closed. The bottom surface 43 is curved in an arciform manner toward the opening and closing cover 5 so at to form a concave shape. An opening 43*a* is provided for weight saving at a portion of the bottom surface 43 of the container SP. That is, a circumferential edge of the opening 43*a* is formed at a portion of the bottom surface 43 of the container SP.

A pair of guide attachment parts 41, 41' is provided for attaching the pair of paper roll guides 6, 6' in the rear part 4B of the frame 4. The pair of paper roll guides 6, 6' supports the sides of the paper roll RP from both sides in the container SP.

As illustrated in FIG. 5, a pair through-holes 46, 46' is formed at the bottom surface 43 of the container SP in order to attach the frame 4 to the body case 3. A pair through-holes 47, 47' is formed outside of the pair of guide attachment parts 41, 41' in order to attach the frame 4 to the front cover 2.

In the frame 4, the opening 43*a* formed in the rear part 4B is an example of a first opening, while the opening 42*a* formed in the front part 4A is an example of a second opening.

(3) Structure of the Body Case 3

Figure 7:
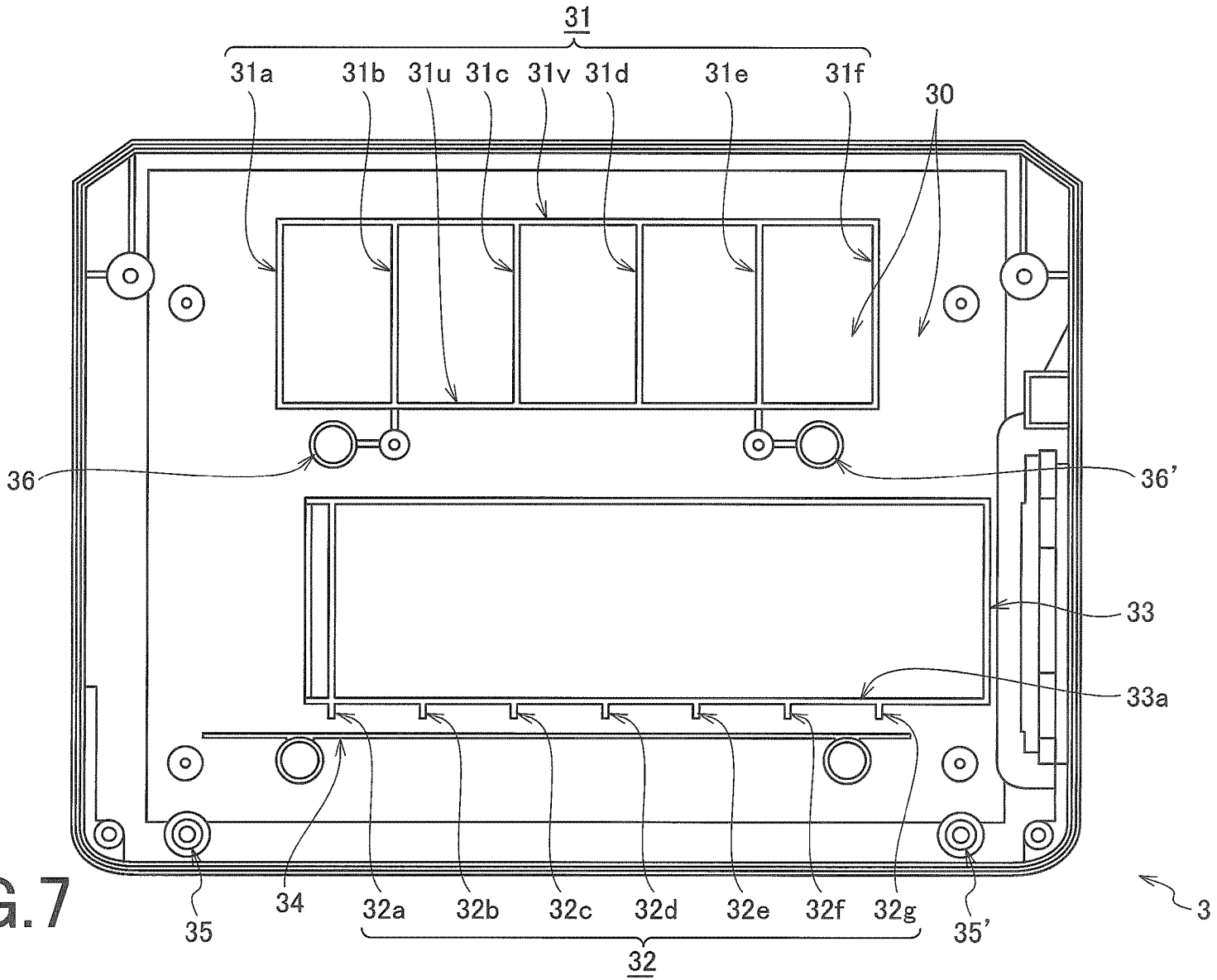
FIG. 7 is a plan view of a body case of the printer according to the embodiment.

Next, the structure of the body case 3 of the printer according to the present embodiment will be described with reference to FIG. 7. FIG. 7 is a plan view of the body case 3 of the printer 1 according to the present embodiment.

As illustrated in FIG. 7, the body case 3 includes: ribs 31, 32 protruding from a bottom surface 30; a rectangular rib 33; and a transverse rib 34. As illustrated in FIG. 2, the body case 3 is disposed outside of the frame 4.

The ribs 31 includes transverse ribs 31*u*, 31*v* formed in a transverse direction of the printer 1 (that is, a direction of the axis of the paper roll RP contained in the container SP), and longitudinal ribs 31*a* to 31*f* formed in a longitudinal direction of the printer 1. The ribs 31 are an example of a first protrusion part. As illustrated in FIG. 7, the transverse ribs 31*u*, 31*v* are spaced apart in a longitudinal direction and disposed in parallel each other. The longitudinal ribs 31*a* to 31*f* are spaced apart in a longitudinal direction and aligned with predetermined distances. The longitudinal ribs 31*a* to 31*f* extend between the transverse ribs 31*u*, 31*v*. A rectangular shape defined by the transverse ribs 31*u*, 31*v* of the ribs 31 and the longitudinal ribs 31*a*, 31*f*, conforms to the shape of a circumferential edge of the opening 43*a* of the frame 4.

As will be described later, the longitudinal ribs 31*a* to 31*f* are curved to form a concave shape that conforms to the shape of the bottom surface 43 of the container SP provided in the frame 4. The concave shape is formed to conform to the shape of the outer circumferential surface of the paper roll RP.

The rectangular rib 33 extends in a longitudinal direction of the battery container 42 of the frame 4 when the body case 3 is assembled with the frame 4. The rectangular rib 33 protrudes from the rectangular opening 42*a* of the battery container 42 of the frame 4 to place the battery thereon.

The ribs 32 includes longitudinal ribs 32*a* to 32*g* that protrude forward from the transverse rib 33*a*. The transverse rib 33*a* corresponds to a long side at the front of the rectangular rib 33. In an example of FIG. 7, the longitudinal ribs 32*a* to 32*g* are spaced apart and aligned with predetermined distances.

The transverse rib 33*a* of the rectangular rib 33 and the longitudinal ribs 32*a* to 32*g* are an example of a second rib.

The transverse rib 34 wholly extends in parallel with the transverse rib 33*a* of the rectangular rib 33 and the longitudinal ribs 32*a* to 32*g* each having relatively short length. As will be described later, the transverse rib 34 is located forward from tips of the longitudinal ribs 32*a* to 32*g* by a predetermined distance so that the flat plate-like portion 42*c* fits a gap between the tips of the longitudinal ribs 32*a* to 32*g* and the transverse rib 34.

The transverse rib 34 is an example of a third protrusion part.

A pair of attachment holes 35, 35' is provided to attach the front cover 2 to the body case 3. For example, screws are inserted downward into through holes (not illustrated) of the front cover 2, and the screws are fit into the pair of attachment holes 35, 35'. Thus, the front cover 2 is coupled to the body case 3. As will be described later, a pair of attachment holes 36, 36' is provided so as to respectively correspond to the pair through-holes 46, 46' of the frame 4. The pair of attachment holes 36, 36' is provided to attach the frame 4 to the body case 3. Each attachment hole is threaded.

(4) Coupling Structure of the Body Case 3 and the Frame 4

Next, a coupling structure of the body case 3 and the frame 4 will be described with references to FIGS. 8 to 11.

Figure 8:
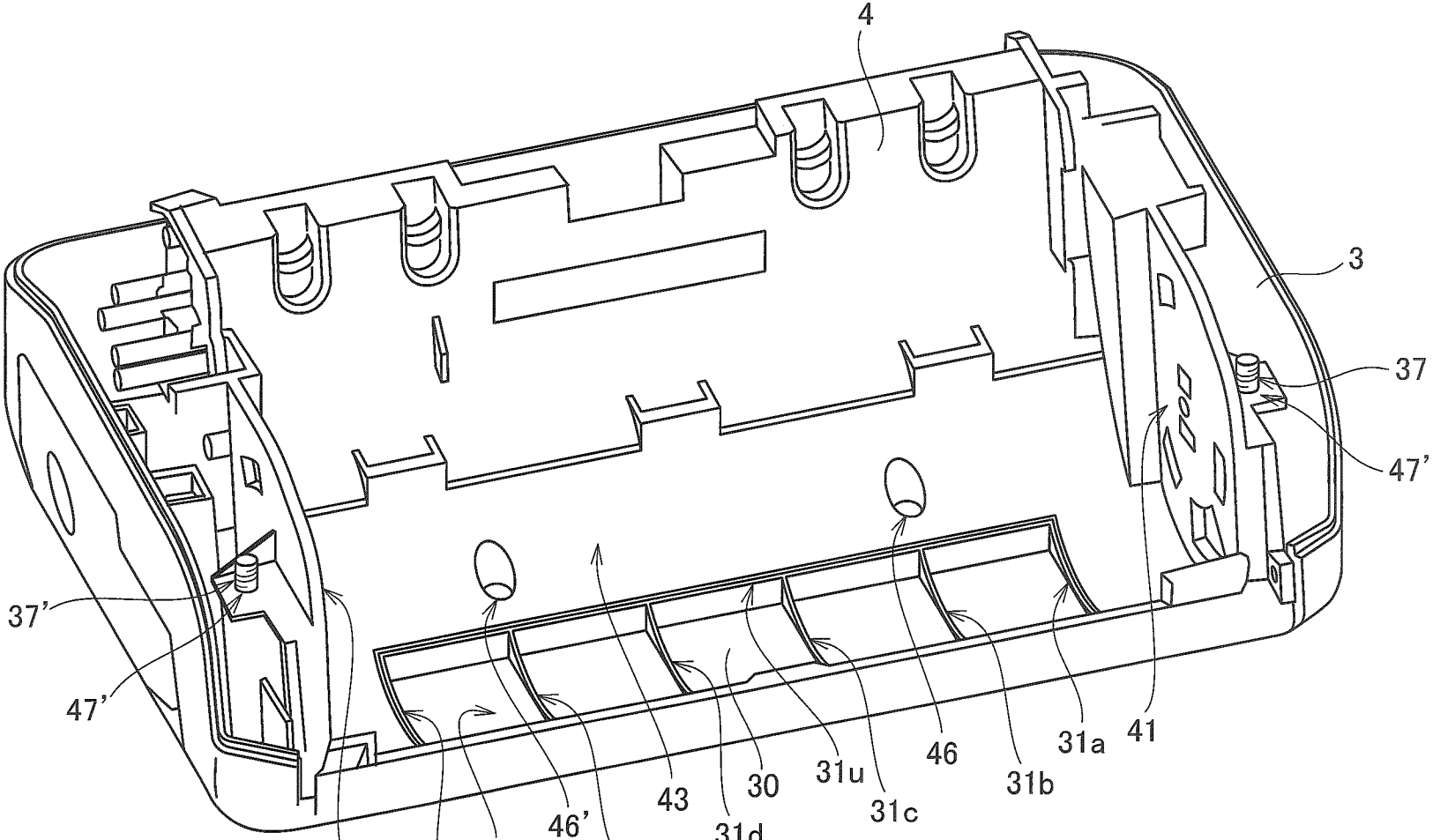
FIG. 8 is a perspective view of a coupled structure of the body case and the frame of the printer according to the embodiment.
Figure 9:
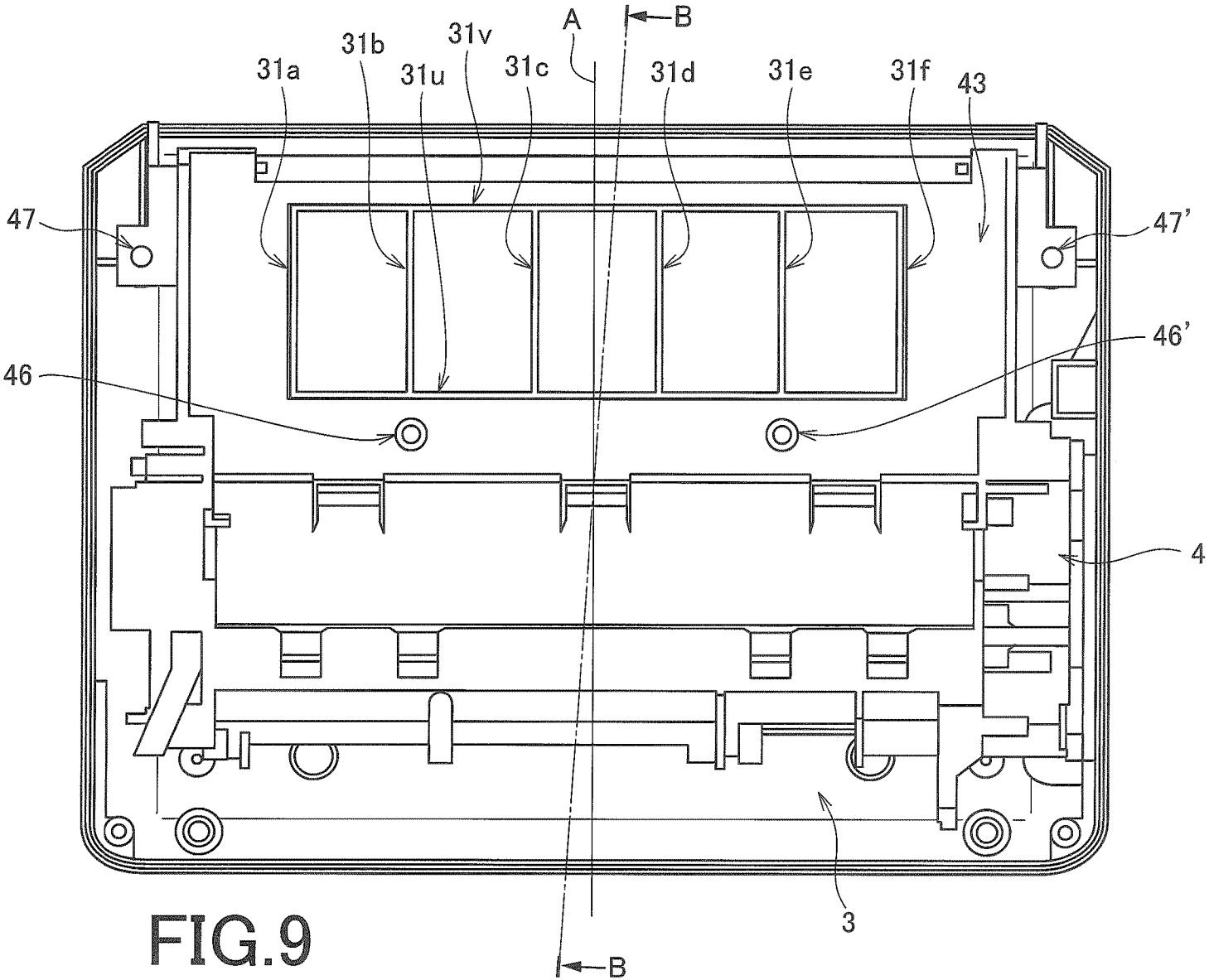
FIG. 9 is a plan view of the coupled structure of the body case and the frame of the printer according to the embodiment.
Figure 10:
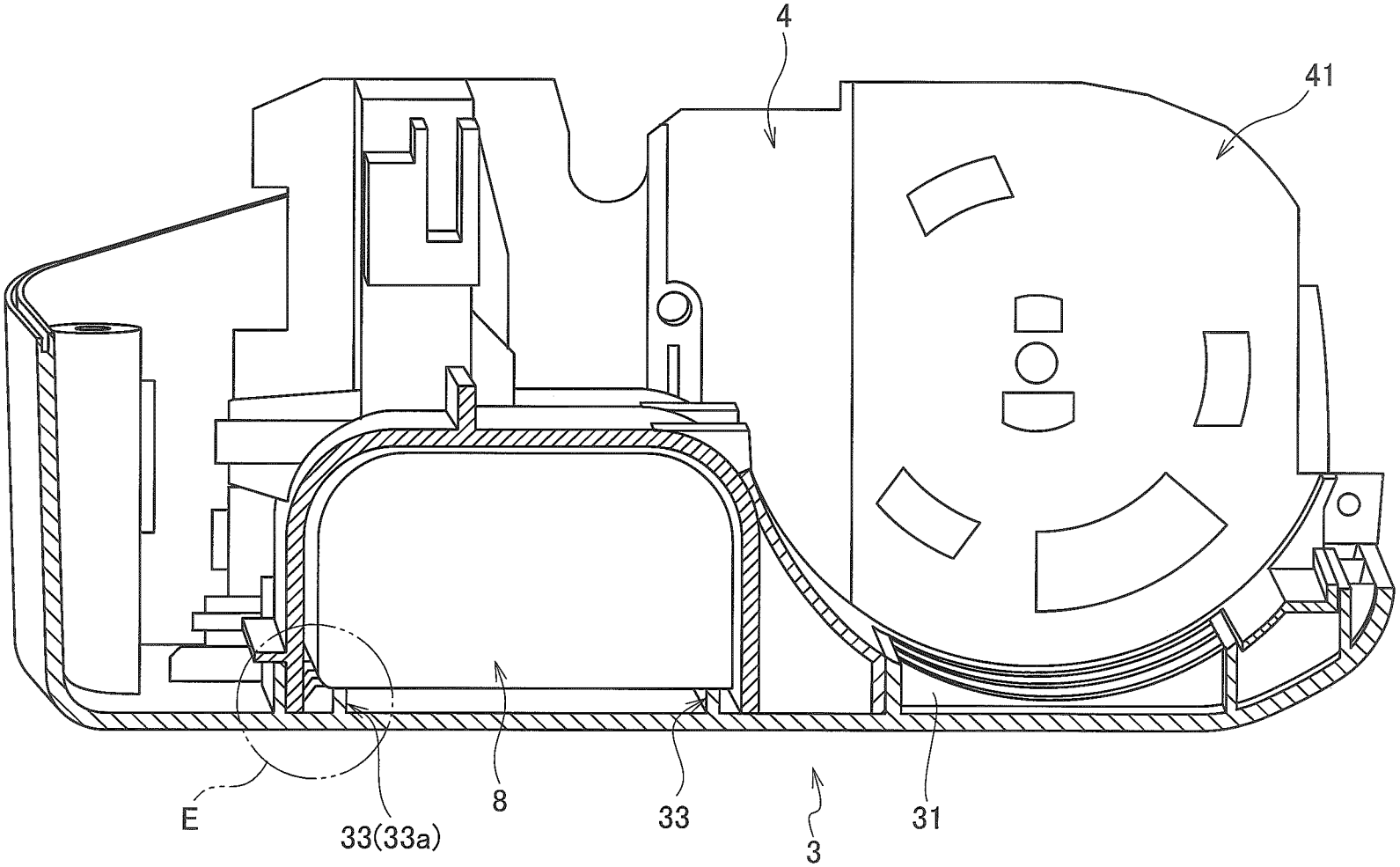
FIG. 10 is a section view of B-B plane in FIG. 9.
Figure 11:
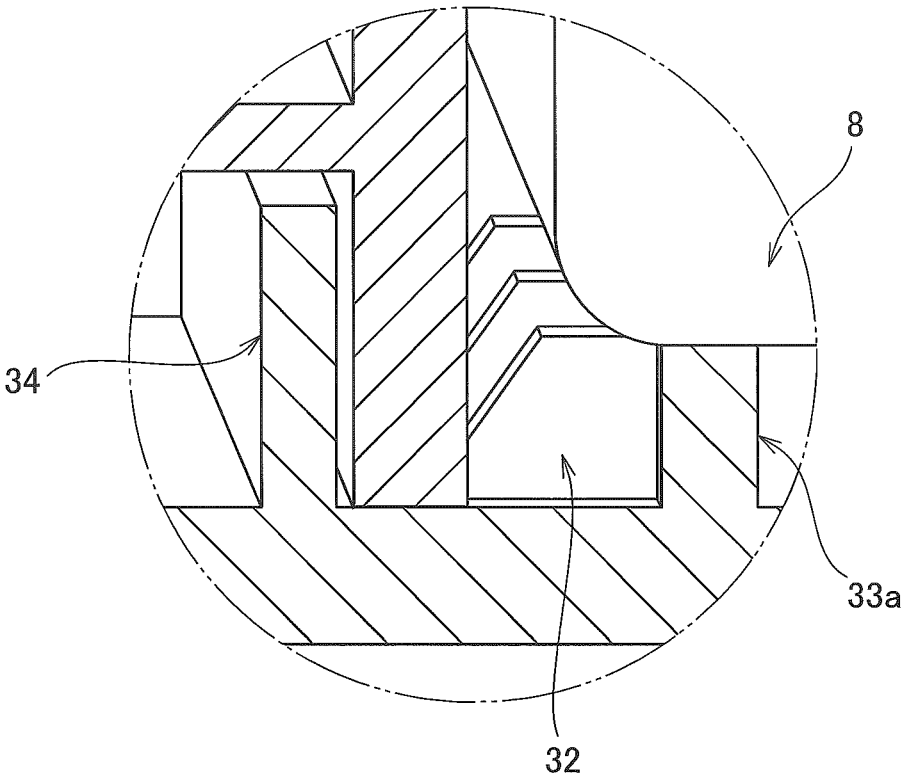
FIG. 11 is an enlarged view of the E part of FIG. 10.

FIG. 8 is a perspective view of a coupled structure of the body case 3 and the frame 4 of the printer 1 according to the embodiment. FIG. 9 is a plan view of the coupled structure of the body case 3 and the frame 4 of the printer 1 according to the embodiment. FIG. 10 is a section view of B-B plane in FIG. 9. FIG. 11 is an enlarged view of the E part of FIG. 10.

A section plane B-B of FIG. 9 is a plane slightly inclined to the front side of the printer 1 from longitudinal plane A of the printer 1.

As illustrated in FIG. 8, a pair of screws 37, 37' are inserted upward into the pair through-holes 47, 47' of the frame 4, and then fitted into attachment holes (not illustrated) of the front cover 2, thereby coupling the frame 4 to the front cover 2. Further, screws are inserted downward into the pair through-holes 46, 46' of the frame 4, and then fitted into the pair of attachment holes 36, 36' of the body case 3, thereby coupling the frame 4 to the body case 3.

As illustrated in FIGS. 7 to 9, when the body case 3 and the frame 4 are coupled, the ribs 31 of the body case 3, which are disposed below the opening 43*a* of the frame 4, protrudes from the opening 43*a*, and thereby the longitudinal ribs 31*a*, 31*f* and the transverse ribs 31*u*, 31*v* of the ribs 31 engage with the circumferential edge of the opening 43*a*.

The longitudinal ribs 31*a* to 31*f* of the ribs 31 are curved to form a concave shape that conforms to the shape of the bottom surface 43 of the container SP, and the concave shape is formed to conform to the shape of the outer circumferential surface of the paper roll RP. Thus, when the body case 3 and the frame 4 are coupled, top surfaces of the longitudinal ribs 31*a* to 31*f* of the ribs 31 and the bottom surface 43 of the container SP integrally place the paper roll RP thereon. In other words, the body case 3 is arranged to be a portion of the container SP.

According to the coupling structure of the body case 3 and the frame 4, the opening 43*a* of the frame 4 contributes to weight saving for the frame 4. Further, thanks to the ribs 31 of the body case 3 that protrude from the opening 43*a* and engage with the circumferential edge of the opening 43*a*, reduction in rigidity of the coupling structure of the body case 3 and the frame 4 is restrained.

As illustrated in FIGS. 10 to 11, when the body case 3 and the frame 4 are coupled, the plate-like portion 42*c* (see FIG. 6) of the battery container 42 of the frame 4 fits the gap between the tips of the longitudinal ribs 32*a* to 32*g* of the body case 3 and the transverse rib 34. Thereby, reliable positioning of the front part 4A of the frame 4 (that is, the part in which the battery container 42 is provided) in a longitudinal direction is achieved.

It should be noted that positioning of the front part 4A of the frame 4 in a longitudinal direction may be obtainable via means other than providing the longitudinal ribs 32*a* to 32*g* of the body case 3. For example, the longitudinal ribs 32*a* to 32*g* may be removed, and the transverse rib 33*a* of the rectangular rib 33 may be relocated to be more forward so that the plate-like portion 42*c* fits a gap between the transverse rib 33*a* and the transverse rib 34.

The section view of FIG. 10 shows a section of an exterior of the battery 8, as well as the sections of the body case 3 and the frame 4. As illustrated in this section view, in the printer 1 according to the present embodiment, the opening

42*a* is formed in the battery container 42 of the frame 4, and the rectangular rib 33 of the body case 3 protrudes from the opening 42*a*. The battery 8 is placed on the top surface of the rectangular rib 33. Thus, the opening 42*a* contributes to weight saving for the printer 1. Thanks to the rectangular rib 33, reduction in rigidity of the coupling structure of the body case 3 and the frame 4 is restrained.

The embodiment of the present invention has been described above; however, the scope of the present invention is not limited to the embodiment described above. The embodiment described above may be improved or modified in various ways that do not depart from the spirit of the present invention. A plurality of technical features explained in the embodiment may be combined as appropriate.

For example, in the embodiment described above, an example has been described in which: a belt-shaped continuous paper including a plurality of meter reading forms each sectioned by a line of perforation, and print medium is a paper roll into which the continuous paper is wound; however, the other type of print medium may be applied.

As described before, a continuous paper may include a liner, one face (label adhesive face) of which a plurality of labels adheres to with predetermined intervals, and the print medium may be a roll into which such continuous paper is wound. In such case, the label adhesive face of the continuous paper may be coated with release agent such as silicon so that the label can be easily released from the liner.

Alternatively, the print medium may be a continuous paper including a print face having a thermosensitive color developing layer thereon and a back face of the print face having an adhesive layer (i.e., linerless label). The print medium may be a journal paper.

In the embodiment described above, an example has been described in which the bottom surface 43 of the container SP is formed in the frame 4 and the opening 43*a* is formed in the bottom surface 43 as a first opening. Here, a shape of the opening 43*a* is not limited to a rectangular, but may be any other shape. Even if the opening 43*a* is of any shape, weight saving will be achieved.

In the embodiment described above, an example has been described in which the ribs 31 as a first protrusion part is formed at the bottom surface 30 of the body case 3. Here, the ribs 31 may not be necessarily formed. If the ribs 31 is not formed, overall rigidity of the printer will be reduced in comparison with that of the printer 1 according to the present embodiment. However, the rear part of the printer 1 is lighter than the front part of the printer 1 that includes heavy components such as the battery 8, the function unit FU, and the like. Therefore, while the opening 43*a* in the rear part 4B of the printer 1 may cause rigidity of the rear part of the printer 1 to be reduced, reduction in total rigidity of the printer 1 will be acceptable level for a practical use.

In the embodiment described above, an example has been described in which the ribs 31 of the body case 3 engage with the entire circumferential edge of the opening 43*a* of the frame 4. However, the ribs 31 may engage with a part of the circumferential edge of the opening 43*a*. For example, in FIG. 7, ribs in the body case 3 may include: the longitudinal ribs 31*a*, 31*b*, 31*e*, 31*f*; and a part of each of the transverse ribs 31*u*, 31*v* which connect the longitudinal rib 31*a* and the longitudinal rib 31*b*. The part of each of the transverse ribs 31*u*, 31*v* engage with the opening 43*a*. The other part of each of the transverse ribs 31*u*, 31*v* may not engage with the opening 43*a*.

In the embodiment described above, a preferable example has been described in which the opening 42*a* as a second opening is formed at the bottom surface of the battery container 42 for the sake of further weight saving; however, the opening 42*a* may not be formed at the battery container 42.

In the embodiment described above, an example has been described in which the rectangular rib 33 of the body case 3, as a second protrusion part, protrudes from the rectangular opening 42*a* to place the battery 8 thereon; however, a part of the body case 3 that places the battery 8 may not be necessarily a rectangular rib. In exchange of the rectangular rib 33, other structure of that part of the body case 3 may be applied so long as it places the battery 8 thereon. For example, ribs including two or more linear ribs aligned in a longitudinal direction or in a transverse direction may be applied to place the battery 8 thereon. A plurality of protrusions scattered in a region defined by the rectangular rib 33 of FIG. 7, in exchange of the rectangular rib 33, may be provided on the bottom surface 30 of the body case 3 in order to place the battery 8 thereon.

In the embodiment described above, an example has been described in which the transverse rib 33*a* of the rectangular rib 33 as a second protrusion part and the relatively short longitudinal ribs 32*a* to 32*g* wholly extend in a longitudinal direction of the battery container 42, and the transverse rib 34 as a third protrusion part extends in parallel with the transverse rib 33*a* and the longitudinal ribs 32*a* to 32*g*. That is, both the second protrusion part and the third protrusion part in the present embodiment are provided in a straight-line-formed structure from a plan view so that the plate-like portion 42*c* fits (engages with) the gap between the protrusion parts (i.e., ribs). However, the plate-like portion 42*c* may not be necessarily a straight-line-formed structure, but may be as appropriate a bent-line-formed structure or a curved-line-formed structure. In such case, the structure of the second protrusion part and the third protrusion part may be defined in accordance with the structure of the plate-like portion 42*c*.

In the embodiment described above, an example has been described in which the thermal head 15 generates heat for printing to be given to the thermosensitive color developing layer of the continuous paper CP; however, other example may be applied. A printer employing other printing method such as an ink ribbon printing method and an inkjet printing method, etc. may be applied.

In the embodiment described above, a rib is applied as an example of each of the first to third protrusion parts; however, other example may be applied. For example, each of the first to third protrusion parts may not be a slight piece like a rib. The protrusion part may be of any shape as long as it engages with the circumferential edge of the opening 43*a*. For example, the protrusion part may be of shape protruding an entire region or a partial region of the opening 43*a*.

The invention claimed is:

1. A printer comprising:

a frame including a first opening formed in a surface thereof, a container configured to receive a roll body in which a belt-shaped print medium is wound, a cover configured to open and close an opening of the container, and a body case provided outside the frame the body case including a first protrusion protruding from a surface of the body case toward the first opening in the frame, and wherein the frame forms a portion of the container, wherein the first opening and the first protrusion are provided within an interior of the body case, and wherein a contour of an end surface of the first protrusion matches a contour along the surface of the frame.

2. The printer according to claim 1, wherein the surface of the frame is formed as a concave surface with respect to an interior of the printer, wherein the end surface of the first protrusion is formed as a concave surface with respect to the interior of the printer that matches the concave surface of the frame, and wherein the concave surface of the frame and the concave surface of the first protrusion match a shape of an outer circumferential surface of the roll body.

3. The printer according to claim 2, wherein the first protrusion engages with a circumferential edge at least partially defining the first opening.

4. The printer according to claim 1, wherein the first protrusion engages with a circumferential edge at least partially defining the first opening.

5. The printer according to claim 1, wherein the frame includes a battery container configured to contain a battery for supplying electric energy to the printer, the battery container including a second opening at a bottom surface thereof, and wherein the body case includes a second protrusion protruding through the second opening, the second protrusion configured to receive the battery thereon.

6. The printer according to claim 5, wherein the second protrusion extends in a longitudinal direction of the battery container, wherein the body case includes a third protrusion extending in parallel with the second protrusion, and wherein the frame includes a plate-shaped part fitting a gap between the second protrusion and the third protrusion.

7. The printer according to claim 1, wherein the frame includes a front part that forms a battery container configured to have a function unit including a thermal head mounted thereon, and a rear part that forms the container configured to contain the roll body in which the belt-shaped print medium is wound.

8. The printer according to claim 1, wherein the body case includes a plurality of the first protrusions.

9. The printer according to claim 8, wherein the plurality of the first protrusions includes at least one protrusion extending in a first direction along an axis of the roll body and at least one protrusion extending in a second direction that is orthogonal to the first direction.

10. The printer according to claim 1, wherein the contour of the end surface of the first protrusion is curved.

11. The printer according to claim 1, wherein the first protrusion protrudes from a surface of the body case toward the first opening in the frame toward the opening of the container.

12. The printer according to claim 1, wherein the end surface forms a boundary of the container.

13. The printer according to claim 1, wherein the first opening defines a boundary of the container.

14. The printer according to claim 1, wherein the first protrusion comprises a rib.

15. The printer according to claim 14, wherein the body case includes a plurality of ribs.

16. The printer according to claim 15, wherein the plurality of the ribs includes at least one rib extending in a first direction along an axis of the roll body and at least one rib extending in a second direction that is orthogonal to the first direction.

17. The printer according to claim 1, wherein an outer perimeter of the first protrusion in a plan view is a closed shape.

18. A printer comprising:

a container configured to contain a roll body in which a belt-shaped print medium is wound;

a frame including a first surface configured to support the roll body from below, the first surface being one of surfaces defining the container and being provided with a first opening; and a body case provided outside the frame, the body case including a first protrusion that overlaps with the first opening in a plan view, the first protrusion protruding from a surface of the body case to a position at which an edge of the first protrusion faces a circumferential edge at least partially defining the first opening in the frame, wherein a surface of the first protrusion facing the container extends along the first surface, wherein the first surface is formed as a concave surface with respect to an interior of the printer, and wherein a top surface of the first protrusion is formed as a concave surface with respect to the interior of the printer that conforms to the first surface.

19. The printer according to claim 18, wherein the body case includes a plurality of the first protrusions.

20. The printer according to claim 19, wherein the plurality of the first protrusions includes at least one protrusion extending in a first direction along an axis of the roll body and at least one protrusion extending in a second direction that is orthogonal to the first direction.

21. A printer comprising:

a frame including a first opening formed in a surface thereof, a container configured to receive a roll body in which a belt-shaped print medium is wound, a cover configured to open and close an opening of the container, and a body case provided outside the frame, the body case including a rib protruding from a surface of the body case through the first opening in the frame, and wherein the frame forms at least a portion of the container, wherein the first opening and the rib are provided within an interior of the body case, and wherein a contour of an end surface of the rib matches a contour along the surface of the frame.

22. The printer according to claim 21, wherein the body case includes a plurality of the ribs.

23. The printer according to claim 22, wherein the plurality of the ribs includes at least one rib extending in a first direction along an axis of the roll body and at least one rib extending in a second direction that is orthogonal to the first direction.

24. The printer according to claim 21, wherein an outer perimeter of the rib in a plan view is a closed shape.

25. A printer comprising:

a frame including a first opening formed in a surface thereof, a container configured to receive a roll body in which a belt-shaped print medium is wound, a cover configured to open and close an opening of the container, and a body case provided outside the frame, the body case including a first protrusion protruding from a surface of the body case toward the first opening in the frame, and wherein the frame forms a portion of the container, wherein the first opening and the first protrusion are provided within an interior of the body case, and wherein a contour of an end surface of the first protrusion forms a portion of the container.

26. The printer according to claim 25, wherein the first protrusion has a rib shape.

27. The printer according to claim 26, wherein a contour of the end surface of the first protrusion matches a contour along the surface of the frame.

28. The printer according to claim 26, wherein the first protrusion engages with a circumferential edge at least partially defining the first opening.

29. The printer according to claim 25, wherein the body case includes a plurality of protrusions, each having a rib shape.

30. The printer according to claim 29, wherein the plurality of the protrusions includes the first protrusion having a rib shape and a second protrusion having a rib shape, the first protrusion extending in a first direction along an axis of the roll body, the second protrusion extending in a second direction that is orthogonal to the first direction.

* * * * *